United States Patent [19]

Trail

[11] Patent Number: 4,549,568

[45] Date of Patent: Oct. 29, 1985

[54] VALVE ENCLOSURE

[76] Inventor: Mel Trail, 36 Still Forest, Houston, Tex. 77024

[21] Appl. No.: 582,941

[22] Filed: Feb. 23, 1984

[51] Int. Cl.[4] ..... G09F 3/00

[52] U.S. Cl. ..... 137/382; 220/85 P; 40/306

[58] Field of Search ..... 40/306, 307; 220/85 P; 137/382, 382.5

[56] References Cited

U.S. PATENT DOCUMENTS

| | | | |
|---|---|---|---|
| 350,182 | 10/1886 | Armendinger | 137/382 |
| 1,575,306 | 3/1926 | Ahldin | 220/85 P |
| 3,006,360 | 10/1961 | Oxenh | 220/85 P |
| 3,648,885 | 3/1972 | Kitsuda | 220/85 P |
| 3,787,993 | 1/1974 | Lyon | 40/306 |
| 4,332,331 | 6/1982 | Fawley | 137/382 |

*Primary Examiner*—A. Michael Chambers
*Attorney, Agent, or Firm*—Gunn, Lee & Jackson

[57] ABSTRACT

In the preferred and illustrated embodiment of the invention, a valve enclosure is disclosed. The enclosure comprises a substantially cylindrical body open at both ends. The cylindrical body includes interior threads at each end thereof and an enlarged central portion between the threaded ends. The valve enclosure is threadably connected to a container including an upstanding valve protruding therefrom and enclosed by the valve enclosure. Visual indicators are provided on the exterior of the valve enclosure body indicating that the container is full or empty.

9 Claims, 5 Drawing Figures

FIG. 1
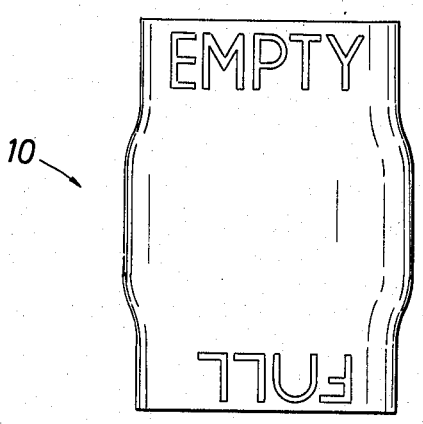
FIG. 2
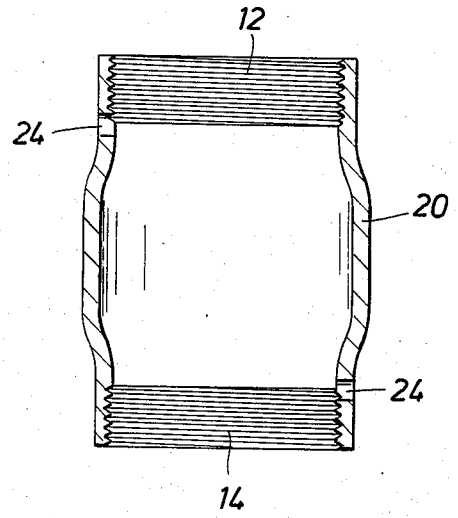
FIG. 3
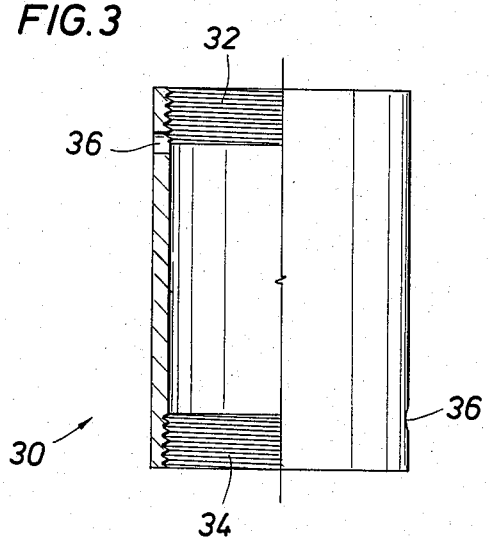
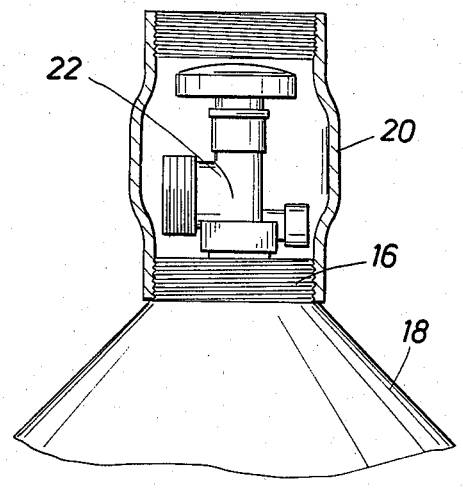
FIG. 4
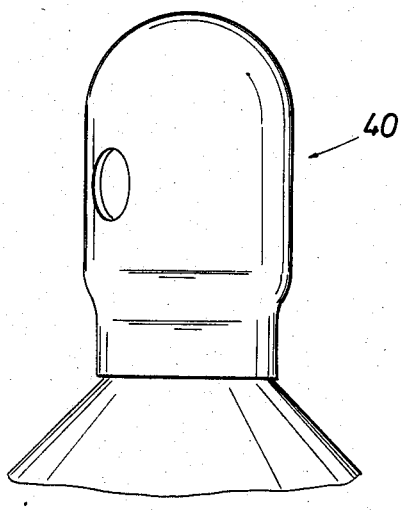
FIG. 5
(PRIOR ART)

VALVE ENCLOSURE

BACKGROUND OF THE DISCLOSURE

This invention is directed to valve enclosures, particularly, to valve enclosures for enclosing an upstanding valve extending from a gas container and including exterior indicators indicating whether the container is full or empty.

Valve enclosures for various type valves are well known in the prior art. Typically, valve enclosures for industrial gas containers are of the dome type. These type of prior art valve enclosures are substantially cylindrical and open at one end. The opposite end of the enclosure is closed. The valve enclosure of the prior art is dome-shaped in profile. Internal threads are provided adjacent the open end of the enclosure for connection to the gas container. The prior art valve enclosure completely encloses the gas container valve. Typically, several vent openings are provided in the body of the valve enclosure.

There are several problems relating to the use of the prior art enclosures, and the novel and unobvious valve enclosure of this disclosure has overcome these problems. One problem that has been overcome, and hence, one advantage of this apparatus is the use of external visual indicators. Often times, empty and full gas containers are transported together or stored in the same storage area. The prior art apparatus do not provide a means for quickly ascertaining which containers are full and which are empty. Use of the invention of the present disclosure saves considerable time by eliminating the trial and error search for a full or empty container.

Another advantage provided by the apparatus of the present disclosure is fire safety. On occasion, the container valve may leak and the gas ignite. In the prior art devices, the flame would flare through the side drain openings and be directed toward any adjacent gas containers. With the present invention, the flame would flare upwardly through the open endof the enclosure. Also, the apparatus of the invention permits venting upwardly through the open end of the enclosure. This overcomes a problem associated with the prior art apparatus which vent through side located openings. In many instances, gas containers provided with the prior art caps would topple over if not supported because escaping gases tended to create a sideward force applied to the containers. Caps and valve stems are likely to be damaged when the gas containers are toppled or jostled against each other.

Yet another advantage provided by the apparatus of the invention is access to the container valve without removing the valve enclosure. The container pressure can easily be released by manipulation of the valve through the open end of the valve enclosure.

Another problem associated with the prior art apparatus is damage to the container connecting threads when the valve enclosure is impacted. The dome design of the prior art apparatus provides structural strength so that upon impact, as in the case when a cannister topples over, the cap tends to separate at the threaded connection with the gas container. The valve enclosure of the present invention is open at the top end permitting the cylindrical side of the enclosure to collapse slightly upon impact. Thus, the force of the blow is absorbed by the enclosure and reduces the risk of failure at the threaded connection between the enclosure and gas container.

SUMMARY OF THE INVENTION

The valve enclosure of the present invention comprises a substantially cylindrical body open at both ends. The body is internally threaded adjacent each end thereof and incorporates an enlarged central portion between the threaded ends in the preferred embodiment. Indicators are provided on the exterior of the valve body for visually determiningwhether a gas container is full or empty. Drain holes provide a means for draining fluid which may accumulate about the container valve.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 is a side view of the apparatus of the invention;

FIG. 2 is a sectional view of the apparatus of the invention shown in FIG. 1;

FIG. 3 is a partial sectional view of an alternate embodiment of the apparatus of the invention;

FIG. 4 is an environmental sectional view of the apparatus of the invention; and FIG. 5 is an environmental side view of a prior art apparatus.

DETAILED DESCRIPTION OF THE PREFERRED EMBODIMENT

Referring first to FIG. 1 of the drawings, the apparatus of the invention is generally identified by the numeral 10. The apparatus 10 is substantially cylindrical in shape and open at each end. The apparatus 10 is approximately five inches in height and three inches in diameter. These measurements may vary somewhat to accommodate specialized valves. The size and shape of the apparatus 10 is determined by the gas container and valve connected thereto. Industrial gas containers have standard connecting threads so that the apparatus 10 may be used with various containers. Typically, the apparatus is used on industrial gas containers containing acetylene, oxygen, or helium gases.

Turning now to FIG. 2, it will be observed that interior threads 12 and 14 are provided adjacent to the open ends of the apparatus 10. The threads 12 and 14 are identical standard threads for connection to the threaded neck 16 of the gas container 18 as shown in FIG. 4. The apparatus 10 includes an enlarged portion 20 between the threads 12 and 14. The enlarged portion 20 is best formed by the cold rolled process and provides an expanded area around the valve 22. In the preferred embodiment, the expanded portion 20 is designed to collapse inwardly upon impact. The expanded area around the valve 22 permits collapse of the portion 20 substantially reducing the risk that the valve 22 will be impacted under normal conditions. The force of the impact is substantially absorbed by the collapse of portion 20. The full impact force is therefore not transmitted to the threaded connection 16 resulting in a substantial reduction in thread separation at 16.

The body of the apparatus 10 is provided with one or more drain openings 24. Two openings 24 are shown in FIG. 2, however, it is understood that additional openings may be provided if desired. The openings 24 are provided to drain water or other fluid which may accumulate within the apparatus 10 about the valve 22. Additionally, the openings 24 provide a grip for a spinner wrench in the event the apparatus 10 cannot be easily unthreaded from the container 18.

In FIG. 3, an alternate embodiment of the apparatus of the invention is disclosed and identified by the reference numeral 30. The apparatus 30 is substantially similar to the apparatus 10 shown in FIG. 1 except that it does not include an enlarged central portion. The apparatus 30 may be a segment of tubing which has been machined and threaded to include threads 32 and 34. Drain openings 36 are also provided. The apparatus 30 is best fabricated by machining or metal casting.

A prior art container cap 40 is shown in FIG. 5. The cap 40 is typical of the prior art apparatus used in the industry incorporating the closed dome design previously described.

Referring again to FIG. 1, it will be observed that notations are provided on the exterior of the apparatus 10 indicating whether the container 18 is full or empty. For illustrative purposes only, the terms "full" and "empty" have been stenciled on the exterior of the apparatus 10. Color coding may also be used. For example, a band of green around one end of the apparatus 10 may indicate "full" while a band of red around the other end of the apparatus 10 may indicate "empty". The visual indicators are very important to the use of the apparatus 10. When the container 18 is full, the apparatus 10 is threadedly connected to the container 10 so that the notation "full" is displayed at the top of the apparatus 10. When the apparatus 10 is empty, it is reversed so that the notation "empty" is displayed at the top of the apparatus 10. The external notations permit one to quickly separate the full containers from the empty ones visually, without having to check by turning the valve or lifting the container.

In the preferred embodiment, the apparatus 10 is fabricated from cold rolled metal. It is understood, however, that the apparatus 10 may be fabricated from other suitable materials. For example, the apparatus 10 may be from metal tubing machined to include internally threaded ends as shown in FIG. 3. Plastic is also a suitable material because it yields upon impact more readily than metal and retains its molded shape.

While the foregoing is directed to the preferred embodiment of the present invention, other and further embodiments of the invention may be devised without departing from the basic invention thereof, and the scope thereof is determined by the claims which follow.

What is claimed is:

1. A valve enclosure for enclosing a valve on a gas container, comprising:

(a) a substantially cylindrical body open at each end, said body including first and second ends having substantially identical interior threads formed thereon for connecting said body to the gas container and orienting said body relative to the gas container to indicate whether the gas container is full or empty;

(b) opening means located in said body adjacent said first and second ends for draining fluid accumulating about the valve; and (c) indicator means on the exterior of said body about said first and second ends for visually determining whether the gas container is full or empty.

2. The apparatus of claim 1 wherein said body includes an enlarged circumferential portion located between said first and second ends.

3. The apparatus of claim 2 wherein said enlarged portion is collapsible and upon impact substantially absorbs the force of impact.

4. The apparatus of claim 1 wherein said cylindrical body is cold rolled.

5. The apparatus of claim 1 wherein said cylindrical body is metal cast.

6. The apparatus of claim 1 wherein said cylindrical body is machined tubing.

7. The apparatus of claim 1 wherein said cylindrical is plastic.

8. The apparatus of claim 1 wherein said indicator means comprise word notations printed about said first and second ends.

9. The apparatus of claim 1 wherein said indicator means comprises a green circumferential bar about said first end of said cylindrical body and a red circumferential bar about said second end of said cylindrical body.

* * * * *